United States Patent [19]

Keem et al.

[11] Patent Number: 4,643,951

[45] Date of Patent: Feb. 17, 1987

[54] MULTILAYER PROTECTIVE COATING AND METHOD

[75] Inventors: John E. Keem, Bloomfield Hills; James D. Flasck, Rochester, both of Mich.

[73] Assignee: Ovonic Synthetic Materials Company, Inc., Troy, Mich.

[21] Appl. No.: 626,663

[22] Filed: Jul. 2, 1984

[51] Int. Cl.[4] ..... B32B 7/02; B32B 15/18

[52] U.S. Cl. ..... 428/469; 428/698; 428/699; 428/472; 428/421

[58] Field of Search ..... 428/698, 699, 469, 421, 428/472

[56] References Cited

U.S. PATENT DOCUMENTS 4,237,184 12/1980 Gonseth et al. ..... 428/698 X 4,268,568 5/1981 Sard et al. ..... 428/421 X

*Primary Examiner*—Nancy Swisher

*Attorney, Agent, or Firm*—James D. Ryndak; Lawrence G. Norris; Richard M. Goldman

[57] ABSTRACT

Multilayer protective coatings that are applied over a substrate are disclosed that comprise a plurality of superimposed multilayer units. Each multilayer unit contains two or more superimposed thin layers in which at least two layers are compositionally different. The properties of the resulting coating are a combination of the properties of the individual layers. One layer of a multilayer unit may provide hardness or wear resistance and another layer may provide lubricity, for example. The thickness of the individual layers can be related to the microscopic surface relief of the substrate to which the protective coating is applied.

20 Claims, 9 Drawing Figures

16
10
16
16
16

MULTILAYER PROTECTIVE COATING AND METHOD

FIELD OF THE INVENTION

The present invention relates to coatings that are applied to surfaces. More particularly, the present invention relates to multilayer coatings having properties which are a combination of the properties of the individual layers.

THE PRIOR ART BACKGROUND

In the past, various types of coatings have been applied to substrates to provide protection for the substrate. For example, a layer of material may be applied which forms the exterior layer over a substrate for improving a property or properties such as wear resistance, corrosion resistance, lubricity, hardness, oxidation resistance, ductility, strength and elasticity. Unfortunately, these properties or many of them are mutually exclusive for a given material. Thus, a single material or composition may possess good hardness but may not have lubricity or some other property that is needed or desired. For example, a coating of aluminum oxide is very inert and hard, but lacks lubricity, a desirable property for the machining of parts. Similarly, lubricious materials such as germanium and fluorocarbons, may not possess sufficient hardness or wear resistance, for example. The resulting coating then is often a compromise which results in optimizing one or more properties but compromises the others.

In view of the foregoing, a need exists for a coating and method which exhibits one or more properties, such as hardness, wear resistance, lubricity, oxidation resistance, corrosion resistance, ductility, strength and elasticity such that the exhibited properties are a combination of the properties of the individual constituents thereof.

DISCLOSURE OF THE INVENTION

In accordance with one aspect of the present invention, protective coatings are provided which are formed on a surface or substrate. The purpose of the coatings is to provide protection from wear, such as that which occurs from cutting and grinding operations and from other hostile environments which may tend to cause oxidation, corrosion and heat degradation, for example. Generally, the surface or substrate is rigid. As used herein, the surface or substrate may include a coating or coatings not in accordance with the invention.

The protective coatings comprise a plurality of superimposed multilayer units. As used herein, "multilayer unit" means two or more superimposed thin layers in which at least two layers are compositionally different. Preferably, each multilayer unit has the same number and types of layers, although this is not necessary. Most desirably, the coating comprises a plurality of repeating multilayer units. The resulting coating has properties that are a combination of the properties of the individual layers.

The layers should be sufficiently thick to obtain the bulk coating properties of the material or composition. Generally, each layer is at least about 50 Angstroms thick to obtain the bulk coating properties of the material and usually less than about 5000 Angstroms. Usually, for wear related applications, the maximum thickness of each layer will be less than the characteristic surface microstructure of the substrate. Generally, this requirement is easily met when the thickness of the layers is about 5000 Angstroms or less. "Characteristic surface microstructure" as used herein refers to the microscopic surface relief of the substrate. Typical highly polished surfaces have surface reliefs of $\pm 0.5$ micrometers (5000 Angstroms) over a distance along the surface of about 0.002 inch. A coarser surface could have correspondingly thicker layers. By limiting the thickness of the layers as described, when a surface is subjected to wear for a sufficient time, a plurality of the individual layers becomes exposed and the surface exhibits properties that are a combination of the properties of the individual layers. This occurs even if the surface is planar on a macroscopic scale.

Each layer of a multilayer unit can be chosen to provide a desired characteristic or characteristics such as, but not limited to, hardness, wear resistance, lubricity, oxidation resistance, heat resistance, corrosion resistance, adherence, elasticity, strength and ductility and combinations thereof. In accordance with a more specific aspect, wear resistant coatings are provided that contain layers for providing hardness and/or wear resistance and layers for providing lubricity.

Generally, at least ten multilayer units will be provided, although as few as two may be utilized. There is no upper limit as to the number of multilayer units that may be utilized, although generally it will be less than about 1,000. The total thickness of the coating will often be in the range of from about 0.5 to about 10 micrometers.

Any material or composition which has a desired property can be utilized as a layer in the multilayer unit. Accordingly, the invention is not limited to the specific materials set forth herein, which are provided by way of example and not as limitations. Each layer should exhibit suitable adherence and compatibility to the adjacent layers. A layer or layers may be included in the coating for improving adherence or compatibility of otherwise adjacent layers.

The specific materials chosen for the coating will, of course, depend on the properties that are desired and the conditions to which the coating will be subjected. The following are examples of different types of materials which may be used to form layers of the multilayer units.

Materials which may be chosen for a layer or layers of a multilayer unit to provide hardness and/or wear resistance include, for example, elements, alloys, stoichiometric compounds, and nonstoichiometric compositions, where applicable, of: titanium and boron; titanium and carbon; tungsten and boron; molybdenum and boron; carbon; aluminum and oxygen; silicon and nitrogen; boron and nitrogen; tungsten and carbon; tantalum and carbon; titanium and nitrogen; zirconium and oxygen; and combinations of such materials. These materials are generally also useful for providing strength.

Preferred compositions include $Ti_xB_{1-x}$, $W_xB_{1-x}$ and $Mo_xB_{1-x}$ where x is less than or equal to 0.5, $Si_xN_{1-x}$ where x is in the range of from 0.4 to 0.6, $B_xN_{1-x}$ where x is in the range of from 0.5 to 0.6, $Ti_xN_{1-x}$ where x is in the range of from 0.5 to 0.7 and $Ti_xC_{1-x}$ where x is in the range of from 0.4 to about 0.6.

Materials which may be chosen for a layer or layers of a multilayer unit to provide lubricity include, for example: germanium; fluorocarbon polymers (for example, tetrafluoroethylene (TFE) resins and fluorinated ethylene-polypropylene (FEP) resins); stoichiometric and nonstoichiometric transition metal borides and combinations of such materials. A preferred transition metal is molybdenum. A preferred composition is $Mo_xB_{1-x}$ where x is less than or equal to 0.5.

Materials which may be chosen for a layer or layers of a multilayer unit to provide for oxidation resistance include, for example: silicon; titanium; carbon (preferably disordered); stainless steel; aluminum; and stoichiometric compounds and nonstoichiometric compositions of aluminum and oxygen, silicon and oxygen, zirconium and oxygen, titanium and oxygen. These materials are also generally suitable for providing corrosion resistance.

Examples of suitable materials which may be chosen for a layer or layers of a multilayer unit to provide elasticity and/or ductility include chromium and stainless steel.

The foregoing examples are set forth as illustrations of suitable materials. It is to be understood that the categories hardness, wear resistance, lubricity and so forth are relative terms and that certain of the materials set forth above may possess properties that are useful for more than one category.

The atomic structure of each layer may be crystalline or amorphous, independent of the other layers. It is believed that disordered wear resistant coatings perform better than single phase crystalline coatings. Disordered layers may be more susceptible than single phase crystalline layers to diffusive bonding between substrate and/or other layers, resulting in better adherence. Disordered materials also lack extended lattice planes through which fractures can propagate and in general can withstand relatively high deformation forces without fracture. Such materials are generally less susceptible to corrosion than single phase crystalline materials. It is believed that the foregoing advantages are more fully realized with amorphous or substantially amorphous coatings. As used herein, the term "disordered" includes amorphous, polycrystalline (and lacking long range compositional order), microcrystalline or any combination of those phases. By the term "amorphous" is meant a material which has long range disorder, although it may have short or intermediate order or even contain at times some crystalline inclusions.

In accordance with another aspect of the invention, the protective coatings provide wear resistance. The wear resistant coatings can include layers for providing wear resistance and/or hardness. Layers may also be included for providing lubricity or other properties, for example. Thus, a wear resistant coating could comprise a plurality of multilayer units with each unit having a layer for providing hardness and/or wear resistance and another layer for providing lubricity. Most desirably, the multilayer units are repeating units.

In accordance with another aspect of the present invention, a coated article is provided that includes a substrate portion having at least a portion of the substrate surface, working edge or working surface with a protective coating applied and adhered thereto. The protective coating is in accordance with the invention as previously described. A plurality of the layers will be exposed when the outer layer has been breached. For example, when the surface has been in use, such as in a wear application, so that at least a portion of the outer layer has been worn through, a plurality of the layers will be exposed over the surface of the coating. The exposed layers result in a surface having properties which are a combination of the properties of the individual exposed layers. In accordance with a more specific aspect, the protective coating is a wear resistant coating or has wear resistant properties.

In accordance with another aspect of the invention, a method is provided for making protective coatings, which method includes depositing a plurality of multilayer units over the surface of a substrate. The multilayer units are as previously described and generally are deposited by depositing the individual layers that make up each multilayer unit.

In accordance with still another aspect of the invention, a method of machining a workpiece is provided. As used herein, "machining" is used in a broad sense and includes, but is not limited to, cutting, grinding, shaping, polishing, reaming, turning, drilling, broaching, sharpening and the like. The method comprises machining a workpiece with an article, such as a tool, for example, having on at least a portion of the article or on a working edge or surface thereof, coated with a multilayer coating in accordance with the invention. Preferably, the coating comprises layers that are thinner than the characteristic surface microstructure. After the article or tool having the protective coating thereon has been in use and sufficient wear has occurred such that at least the outer layer of the coating has been worn through over at least a portion of the coating, a plurality of the layers of the coating will be exposed.

Another aspect of the invention is a method of protecting a surface that comprises applying a protective coating of the invention on at least a portion of the surface of the article. The protective coating may be tailor-made to provide the desired protection and characteristics, such as, for example, wear resistance, hardness, lubricity, corrosion resistance, oxidation resistance, heat resistance, fracture resistance (ductility), strength, and combinations thereof. The conditions to which the article will be subjected determines in part the type of multilayer coating that is to be applied.

DETAILED DESCRIPTION

Figure 1:
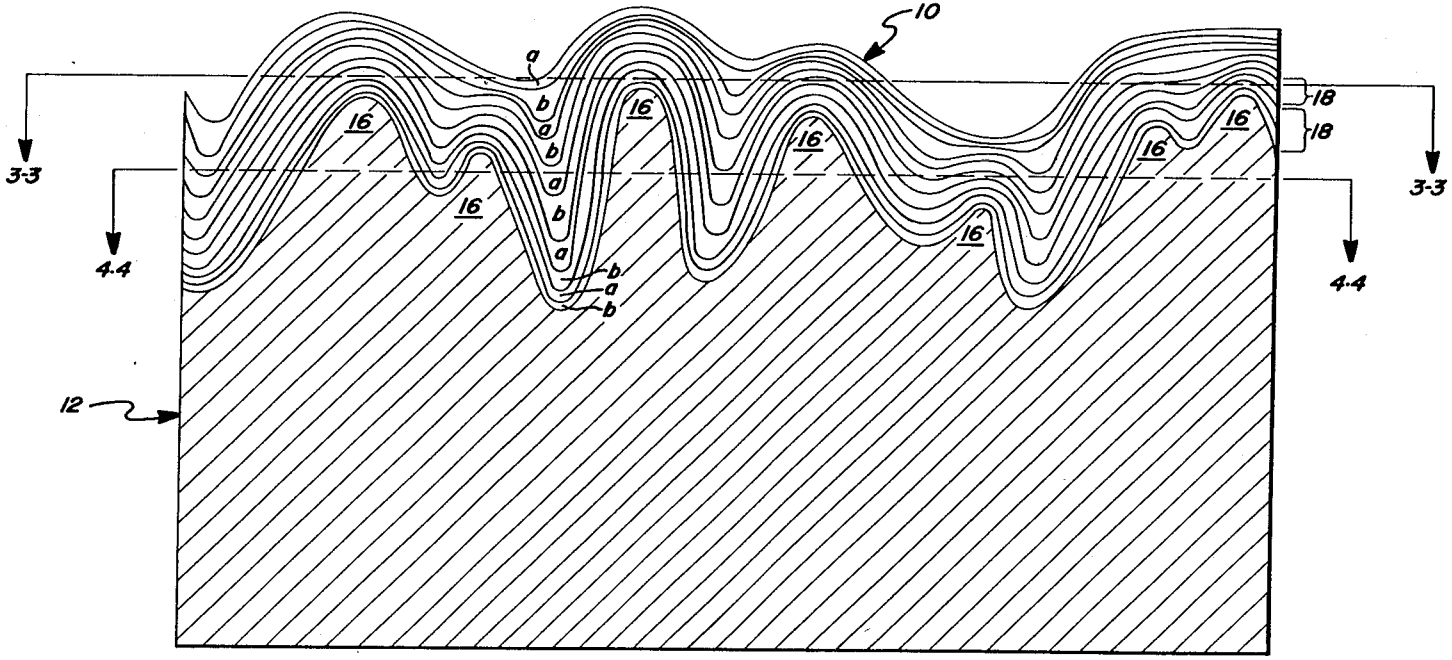
FIG. 1 illustrates in sectional view a multilayer protective coating in accordance with the invention applied to a substrate.

Referring to the figures generally and in particular to FIG. 1, there is illustrated greatly enlarged in sectional view a protective coating 10 in accordance with the invention that has been applied to a substrate 12. As previously described, for wear applications, it is desirable that the substrate have microscopic surface relief or microscopic deviations from a planar surface. This allows a plurality of the layers of protective coating 10 to be exposed during use, allowing the exposed surface to exhibit the properties of the materials present in the individual layers.

Figure 2:
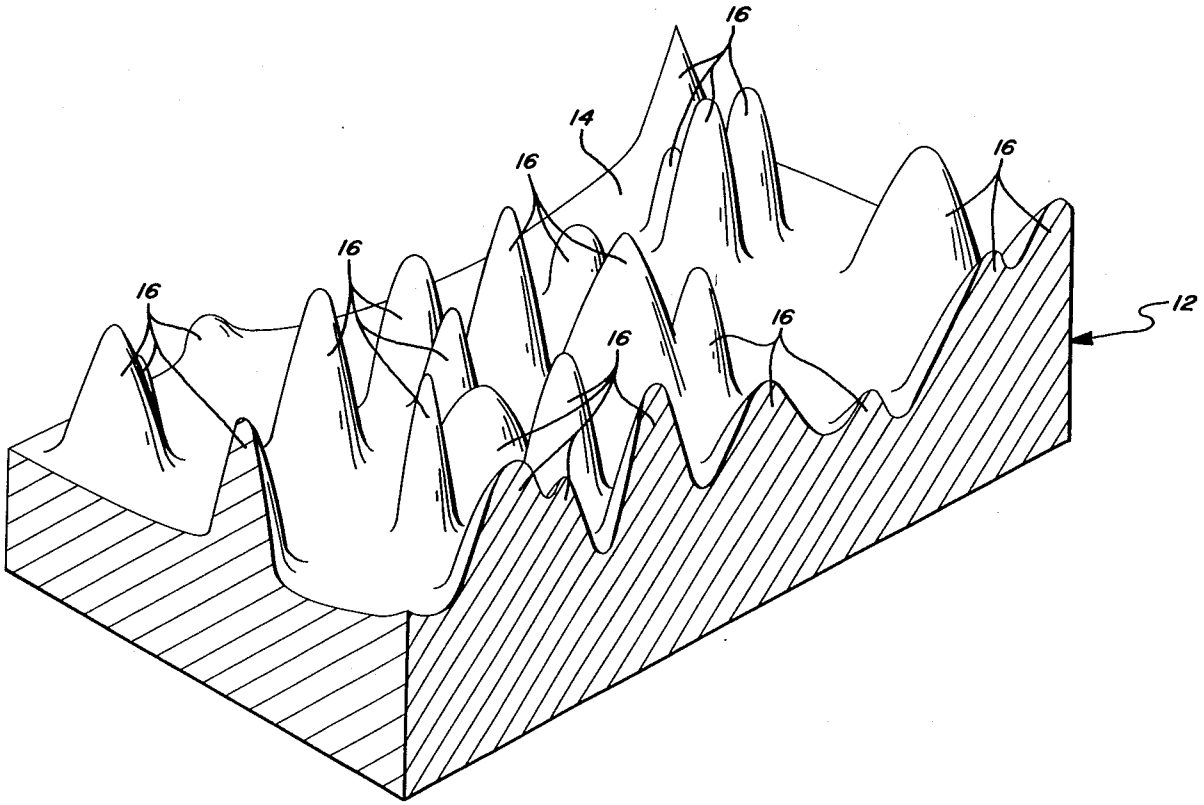
FIG. 2 illustrates in perspective view the substrate surface of FIG. 1 prior to application of the coating.

Substrate 12 is illustrated in perspective view in FIG. 2 prior to application of protective coating 10. The surface 14 of substrate 12 to which protective coating 10 is applied is macroscopically planar but microscopically nonplanar having microscopic surface relief. In this case, the surface relief consists of a plurality of peaks 16. Peaks 16 are microscopic surface imperfections or defects which may or may not be essentially randomly oriented on surface 14. Peaks 16 are illustrative of one type of microscopic surface relief imperfection which may be encountered.

Another type of microscopic surface imperfection consists of "ridges", shown and hereinafter described with respect to FIGS. 5–7. Other microscopic surface imperfections may consist of, for example, combinations of peaks and ridges, or any type of variation from a planar surface. Virtually every surface that will be encountered will have such microscopic deviations from a planar surface.

Protective coating 10 may be a wear resistant coating which is made up of a plurality of repeating overlaying multilayer units 18. Each multilayer unit is made up of two compositionally different layers indicated in FIG. 1 by reference letters "a" and "b". One or both layers of multilayer unit 18 may be chosen for hardness or wear resistance, or one layer may be chosen for hardness or wear resistance (aluminum oxide, for example) and the other layer chosen for lubricity (molybdenum diboride, for example).

Preferably, the multilayer units are repeating units, that is, the units have the same number, composition and order of layers. Thus, the multilayer units may comprise, for example, where each letter represents a different layer of material and each group of letters represents a multilayer unit: ab, ab, ab, etc.; abc, abc, abc, etc.; abcd, abcd, abcd, etc. Many combinations of multilayer units are possible: ab, abc, ab, etc.; ab, ac, ab, etc.; abcd, abc, ab, abcd, etc.; abc, bac, abc, etc.; ab, cd, ef, etc.; abba, abba, etc. While each multilayer unit in the coating could have different materials, it is generally advantageous for the multilayer units to be repeating, since the application of the coating is facilitated. The foregoing combinations are merely set forth by way of example and not by way of limitation.

The thickness of each layer in a multilayer unit can be as desired within the previously described guidelines relating to bulk properties and characteristic microstructure where it is desired to expose a plurality of layers, such as in wear related applications. Preferably, each repeating multilayer unit will have about the same thickness and corresponding layers will also have about the same thickness.

When a coating in accordance with the invention, such as protective coating 10, is applied to a substrate, such as substrate 12, and used in a wear or similar application, as the surface of coating 10 is breached, in this case from wear, a plurality of the layers of the coating became exposed.

Figure 3:
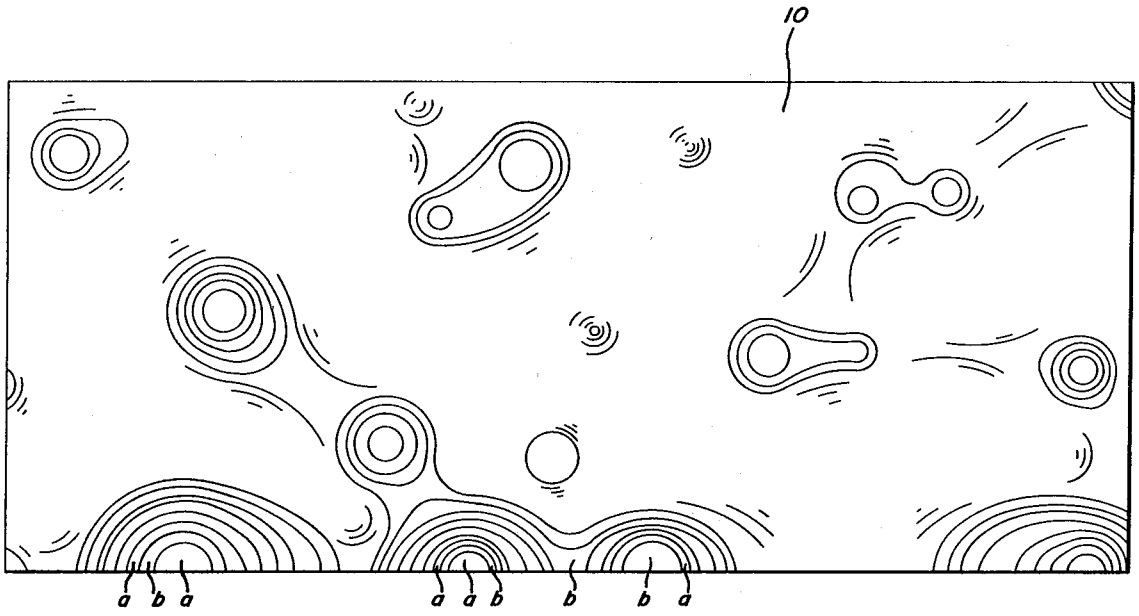
FIG. 3 illustrates the coating of FIG. 1 along lines 3—3 of FIG. 1.

FIG. 3 is an illustration of the surface of protective coating 10 after a portion thereof has been breached along lines 3—3 of FIG. 1. As shown in FIG. 3, a plurality of individual layers a and b are exposed providing a surface that has properties that are a combination of the properties of individual layers a and b.

Figure 4:
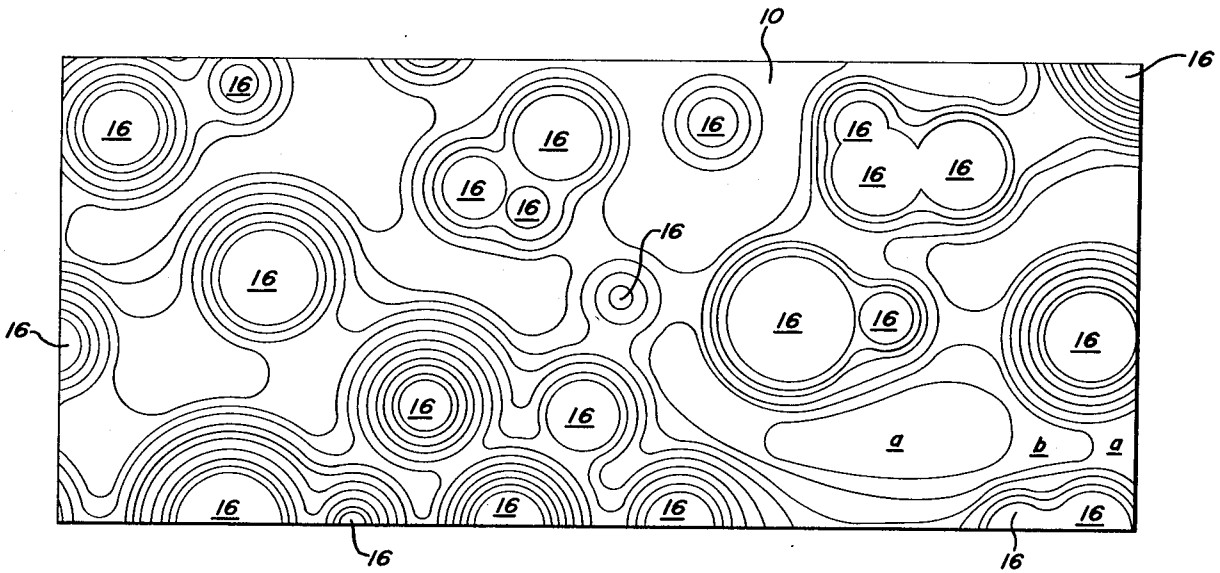
FIG. 4 illustrates the coating of FIG. 1 along lines 4—4 of FIG. 1.

Protective coating 10 is shown in FIG. 4 along lines 4—4 of FIG. 1 after further wear has taken place. In certain locations, protective coating 10 has been worn down to substrate 12 and these areas are depicted as circular in FIG. 4 and correspond to surface reliefs of substrate 12 in the form of peaks 16. The noncircular areas of FIG. 4 correspond to the layers of protective coating 10 that are exposed at the surface. Thus, the surface is made up of a plurality of areas of exposed layers of protective coating 10 and exposed areas of substrate 12.

It is to be understood that the illustrations of FIGS. 3 and 4 are provided by way of example only and that the actual wearing or breaching of the coating may not occur in a planar fashion as illustrated, although the result will still be that a plurality of layers are exposed.

Figure 5:
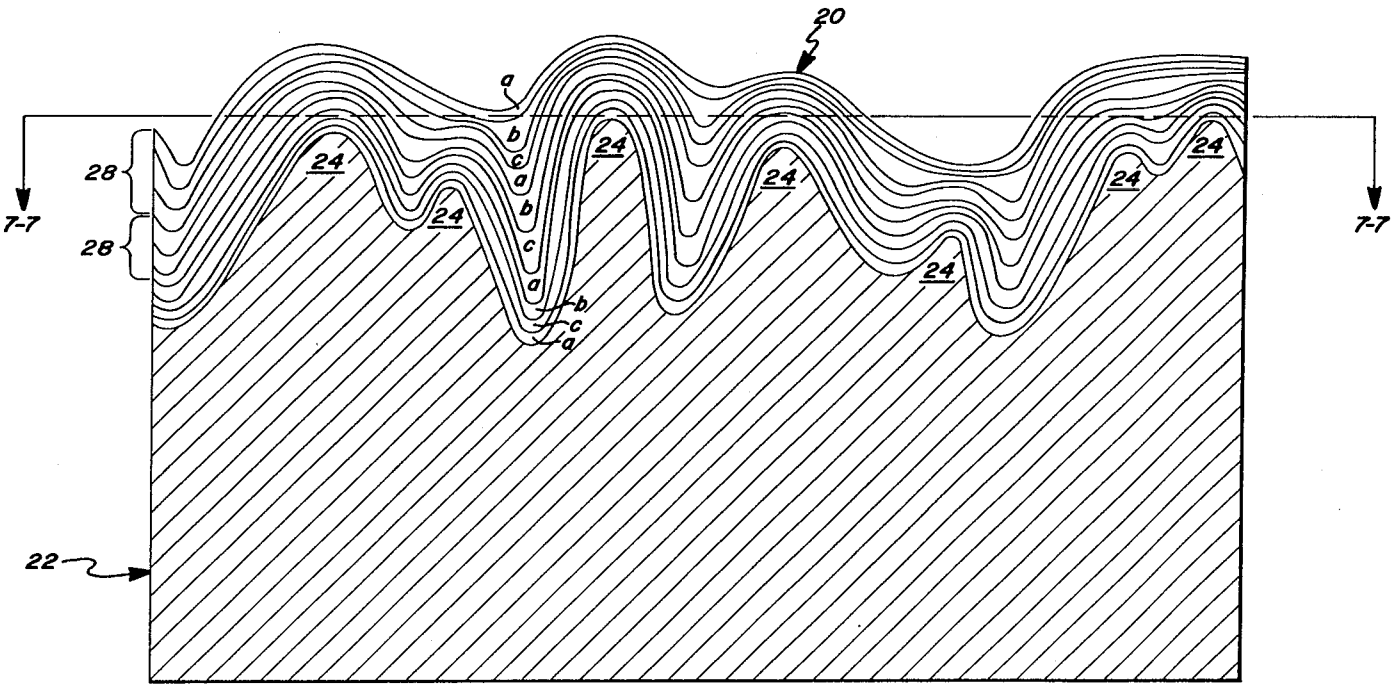
FIG. 5 illustrates in sectional view another multilayer protective coating in accordance with the invention applied to a substrate.
Figure 6:
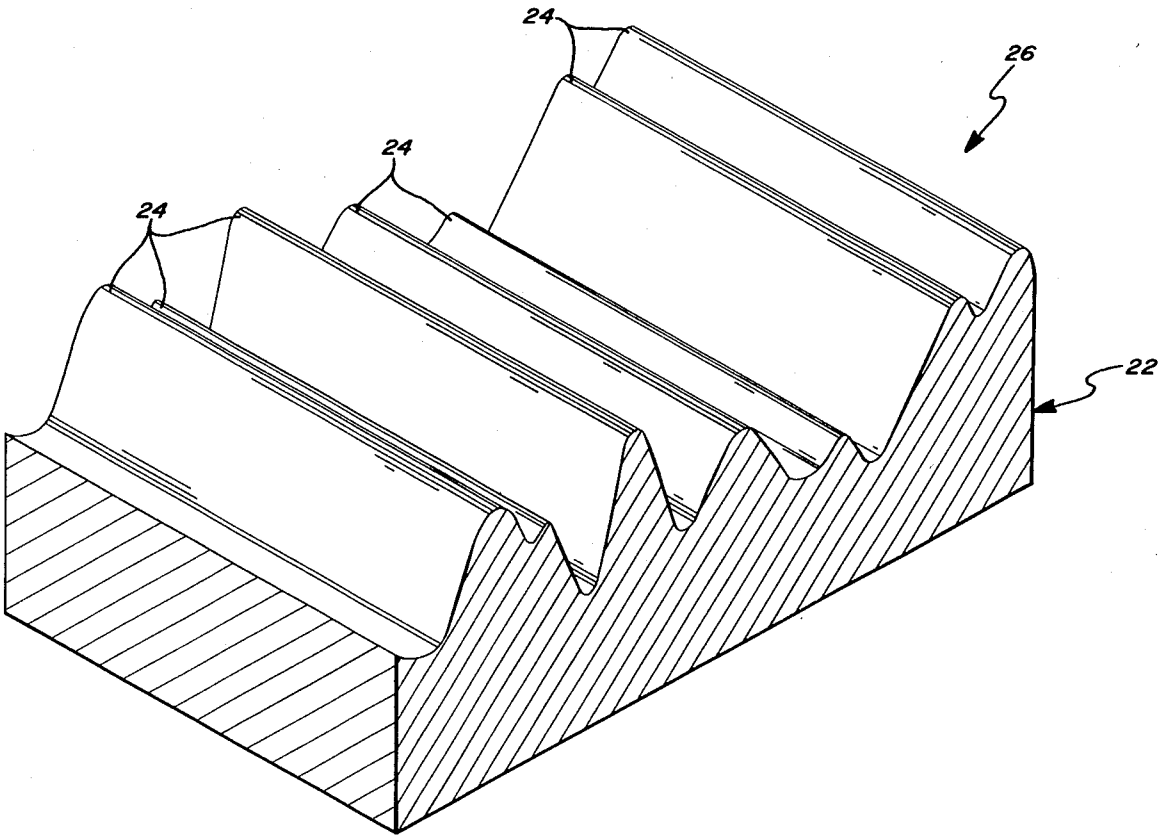
FIG. 6 illustrates in perspective view the substrate surface of FIG. 5 prior to application of the coating.

Referring to FIG. 5 there is illustrated greatly enlarged in sectional view a protective coating 20 in accordance with the invention that has been applied to a substrate 22. In this illustration, substrate 22 has microscopic deviations or surface relief that consists of a plurality of ridges 24. Ridges 24 are better illustrated in FIG. 6, which shows substrate 22 prior to application of protective coating 20. Ridges 24 form part of the surface 26 of substrate 22.

Protective coating 20 is made up of a plurality of overlaying multilayer units 28. Each multilayer unit is made up of three layers, indicated in FIG. 5 by reference letters "a", "b" and "c". Each layer is smaller than the characteristic surface microstructure or surface relief of substrate 22.

Figure 7:
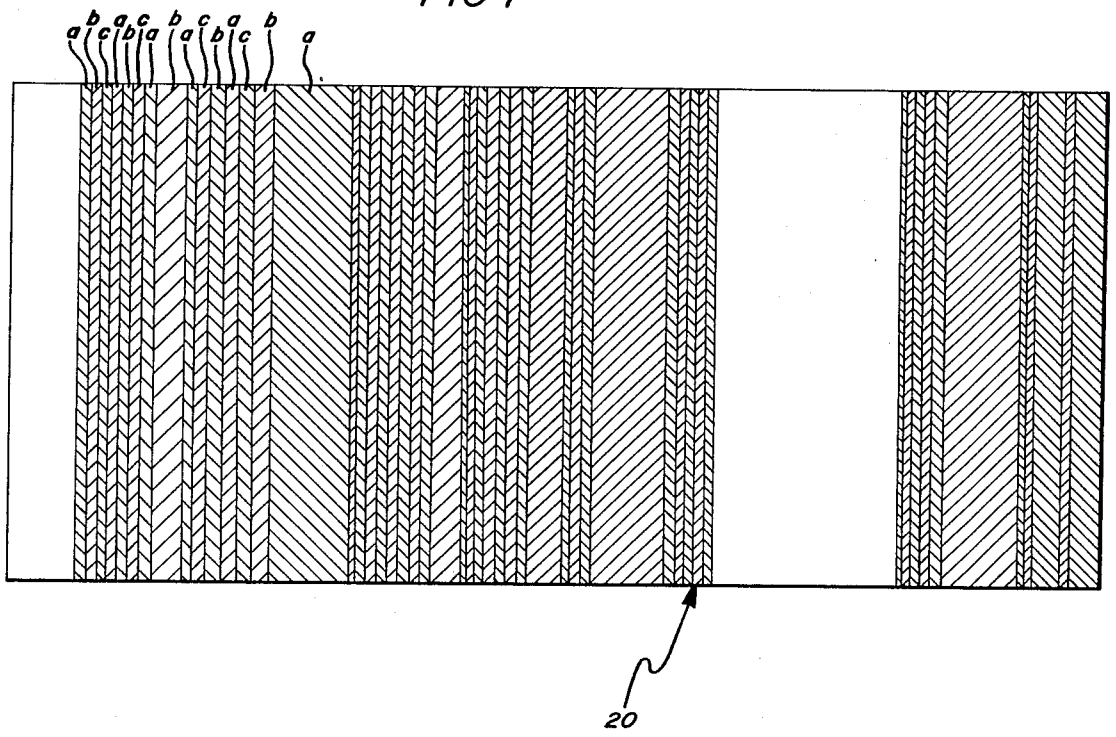
FIG. 7 illustrates the coating along lines 7—7 of FIG. 5.

Referring to FIG. 7, there is illustrated the surface of protective coating 20 along lines 7—7 of FIG. 5 which is illustrative of the condition which may occur after a portion of protective coating 20 has been worn away. The various layers a, b and c that form the exposed surface of protective coating 20 result in a surface having properties that are a combination of the properties of the individual exposed layers.

Figure 8:
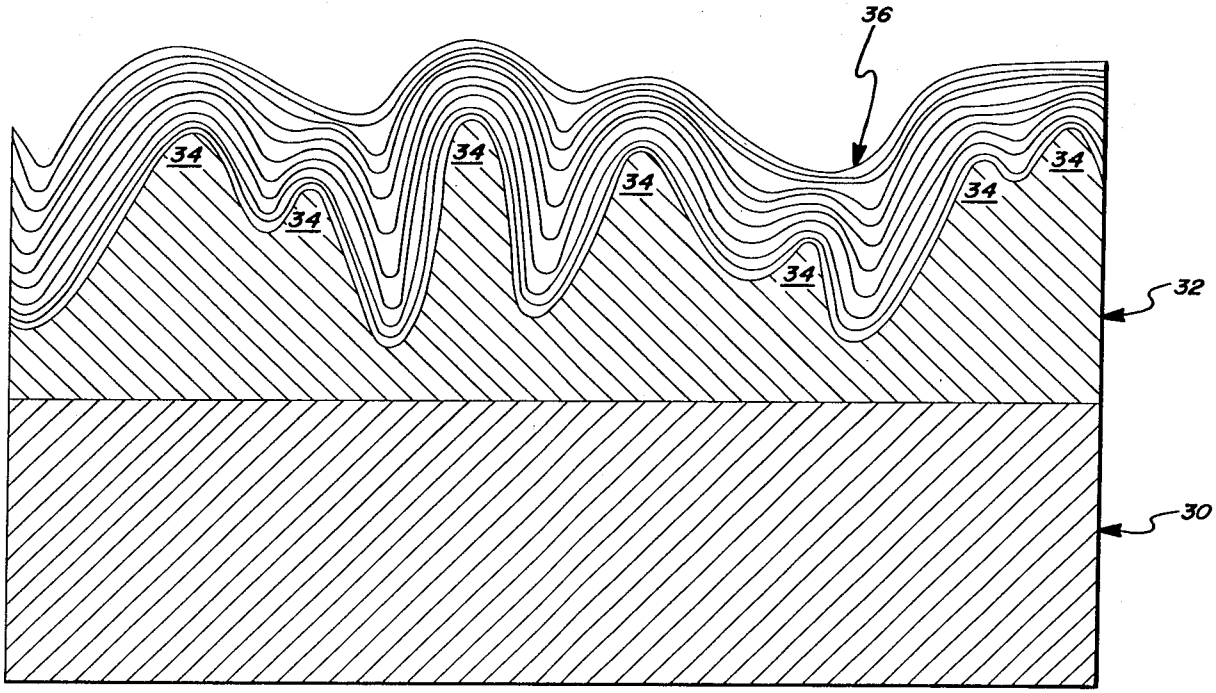
FIG. 8 illustrates in sectional view another coating in accordance with the invention applied to a substrate.

An alternate embodiment of the invention is illustrated in FIG. 8. A substrate 30 is depicted as having a flat surface, although the surface may have surface reliefs as previously described. Substrate 30 has been coated with a layer 32 which has a columnar microstructure which consists of a plurality of columns or peaks 34. The spacing or packing density of the columns or peaks can be varied. Layer 32 can be utilized to provide a surface having a desired surface relief, for example, or can form part of a multilayer unit in accordance with the invention. Over layer 32 is a protective coating 36 similar to coating 10. If coating 36 is utilized in a wear related application or the like such that a portion of coating 36 is worn away, the exposed surface of coating 36 may be similar to that described in conjunction with FIG. 3, where a plurality of layers of coating 36 are exposed at the surface.

Figure 9:
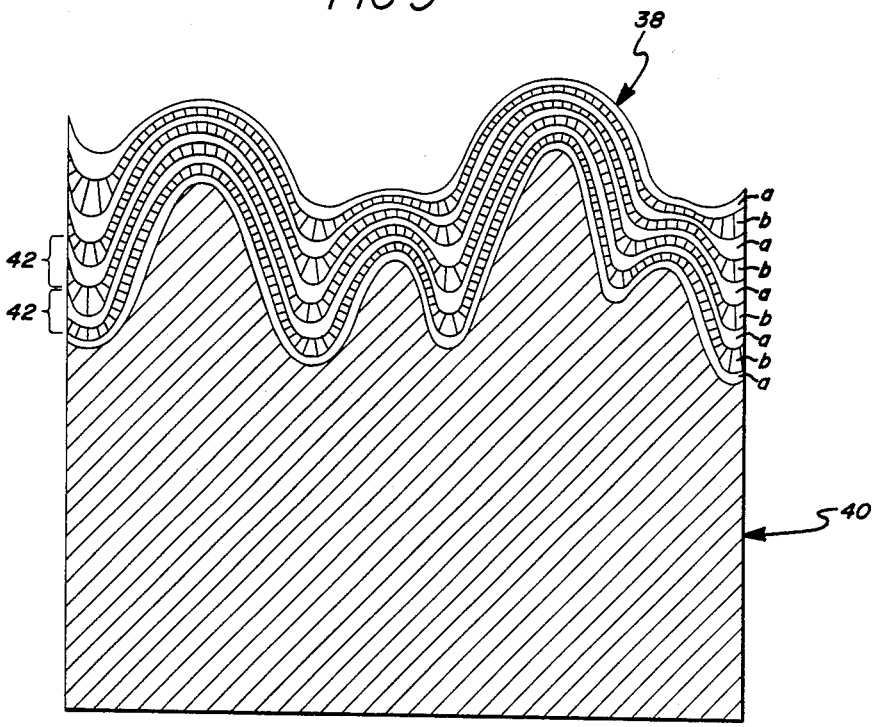
FIG. 9 illustrates in sectional view another coating in accordance with the invention applied to a substrate.

Still another embodiment of the invention is illustrated in FIG. 9. A coating 38 is provided over a substrate 40. Coating 38 includes a plurality of multilayer units 42, each consisting of two layers, referred to in FIG. 9 by reference letters "a" and "b". The morphology of the "a" layers is non-columnar while the morphology of the "b" layers is columnar. The packing density of the columns in the "b" layers can be varied. For example, the columnar layers may have a very close packing density in which the columns of the layer are essentially adjacent, or the columns of the layer may be spaced to a lesser or greater degree.

The materials chosen for the coatings and the application thereof to a substrate should be such that suitable adherence to the substrate and suitable adherence between the individual layers is obtained.

Generally, suitable adherence can be achieved by proper selection of materials relative to the material that will be adjacent a particular material.

Proper selection can generally be accomplished by meeting any one or more of the following requirements for a layer relative to the layers or substrate immediately adjacent to that layer. Any of these requirements for one of the adjacent layers can be fulfilled independently of the requirement that is fulfilled for the other adjacent layer. The requirements are: (1) the presence of at least one element common to the particular layer and adjacent layers; (2) the presence of at least one element in the particular layer having about the same atom size as at least one element in the adjacent layers; (3) at least one element in the particular layer composition which, upon migration into an adjacent layer forms a composition in that layer having the same atomic structure as that layer prior to migration; (4) the presence of at least one element in the particular layer that is soluble in the adjacent layers; and (5) the presence of at least one element in the particular layer that has a high bond energy between at least one element in the adjacent layers.

A layer or layers in the coating or multilayer unit can be provided primarily for achieving good adherence of otherwise adjacent layers. The adherence layer can comprise one or more elements, an alloy or a compound, for example, that meets one or more of the foregoing requirements relative to adjacent layers.

The method of coating formation can also be important in making coatings that have suitable adherence. The coatings are preferably sputter deposited, although any suitable technique can be utilized. Other techniques which may be suitable include other physical vapor deposition methods, such as evaporation and ion plating. Chemical vapor deposition, plasma spraying and electrodeposition processes may also be suitable. Sputtering allows the coatings to be applied at relatively low temperature and is less likely to affect the substrate properties than other techniques which require relatively high temperature.

One method of making the multilayer coatings by sputtering utilizes a carousel which carries the articles or tools that are to be coated. Targets for the sputtering are provided in spaced relation from each other outside the periphery of the carousel. Each target corresponds to the material that is to be deposited for a particular layer of a multilayer unit. During sputtering, the carousel is rotated so that each article carried by the carousel passes in front of each target. As a particular article passes a target, a thin layer of material from that target is deposited on the surface of the article. By adjusting the power that is applied to each target, the rate of deposition of each layer can be controlled, thereby controlling the layer thickness.

While sputter depositing techniques are generally known to those skilled in the art, to maximize the benefits of the invention, it is advantageous to form the desired coatings with sputtering techniques that are adapted to the particular geometry of the surface to be coated. Suitable general sputtering techniques, which are set forth as examples and not as limitations on the present invention, include rf diode, rf magnetron and dc magnetron sputtering. If desired, a dc or rf bias may be applied to the substrate during application of the coating by sputtering. The bias may improve adhesion of the coating formed on the substrate, reduce stress in the coating and increase the density of the coating. When applying the coating, the substrate geometry in part determines the most desirable sputtering technique for a particular application.

Prior to sputter depositing, generally it is important to provide an atomically clean surface on the portion of the tool or substrate surface that is to be coated (as used in this specification, "substrate" means that portion of a tool or substrate exclusive of a coating or coatings in accordance with the invention). This facilitates the formation of a uniform coating which adheres to the substrate surface. There are several methods known to those skilled in the art for providing an atomically clean surface for sputtering and any such method may be utilized. The following surface preparation method is provided by way of example only and is not to be construed as a limitation upon the present invention.

In accordance with one method for providing an atomically clean substrate surface, the substrate is degreased with a chlorinated hydrocarbon degreaser. Thereafter, the substrate is rinsed in methanol and is then subjected to either plasma or dry chemical etching. When plasma etching is utilized, preferably a fluorinated carrier gas, such as carbon tetrafluoride is utilized. The carrier gas decomposes and provides fluorine which cleans the substrate surface. The final step for providing an atomically clean surface for the coating is sputter etching in an argon plasma.

After an atomically clean surface has been provided on the substrate or at least on that portion of the substrate which is to be coated, the coating can be applied.

Preferably, the coating is applied by sputtering. The preferred sputtering conditions depend on surface geometry and the type of microstructure desired. Generally, it is desirable for the surface of the coating to be smooth, especially for many wear-related applications. The internal microstructure of the coating may be columnar or non-columnar. For some applications, a columnar surface for the exterior coating can be desirable.

When it is desired to produce a columnar microstructure, any type of sputtering technique known in the art which produces a columnar microstructure can be utilized. One technique for producing a columnar microstructure applies sufficient bias voltage to the substrate to cause formation of the columnar microstructure. For some coating materials and/or substrate geometries, a columnar microstructure may not be formed, even with a high bias voltage. As is known to those skilled in the art, bias sputtering is the process of maintaining a negative bias voltage on the substrate during deposition.

By applying a bias voltage to the substrate, the density, purity, adhesion and internal stress of the coating can be controlled. Generally, application of a bias voltage tends to increase the density, purity and adhesion and also tends to decrease internal stress of the coating.

The bias voltage applied to a substrate during sputtering may be varied in a desired sequence. The preferred bias sequencing depends on the substrate geometry and the desired coating microstructure. For complex shapes, or for surfaces having a relatively high (about 2.0 or greater) aspect ratio (which is the ratio of the macroscopic depth to the width of a surface, e.g. the aspect ratio of a planar surface is 0 and the aspect ratio of a surface having a depression whose depth equals its width is 1), it is desirable to initially sputter the materials onto the substrate at a relatively low bias voltage (for example, about −100 to −200 volts) to insure complete coverage. Thereafter, the bias voltage is increased to a relatively high bias voltage (for example, about −1000 to −2500 volts). The biasing voltage can be gradually increased (ramp increased) or step increased. Utilizing such a bias voltage tends to promote a more dense, purer coating having greater adhesion, less internal stress and also tends to promote columnar growth. It is believed that a columnar microstructure generally results in better adherence, possibly as a result of mechanical anchoring to the substrate. For a surface with a high aspect ratio, the bias voltage can be applied as for the adherence coating, except that if a smooth surface is desired, towards the end of the deposition the bias voltage is lowered (for example, generally to about −100 to −200 volts) or eliminated, which tends to allow formation of a smooth surface.

For a surface having an aspect ratio of about 0.5 to about 2.0, the coating is preferably sputtered at essentially a constant bias voltage, generally between −500 and −1000 volts. A higher voltage can be used if desired. Preferably, the bias voltage during application of the portion of the coating that forms the outer surface is such that a relatively smooth outer surface is provided.

For surfaces having relatively low aspect ratios (between 0 and about 0.5), preferably the bias voltage initially is higher (about −1000 to −2500 volts) and can be decreased to low voltage (about −100 to −200 volts) or eliminated, in either step or ramp fashion.

Since sputtering can take place at relatively low substrate temperatures (generally about 200° C. or less, for example), the coatings can be formed while avoiding significant changes in the properties of the substrate material while providing a surface that has increased resistance to wear and excellent lubricity. Accordingly, the invention is particularly useful for coating materials such as tool steel, tungsten carbide, cemented carbides, graphite, plastics and other substrate materials that are adversely affected by elevated temperature, for example, since the processing temperature does not degrade the properties of these materials. Sputtering at low substrate temperatures also allows formation of the coatings in a disordered state. The invention is also particularly suitable for coating precisely dimensioned substrates, regardless of substrate composition.

It is to be understood that the interface between two particular layers of a multilayer coating in accordance with the invention may be a combination of the material present in the two layers. Thus, some mixing or overlap of the layers may be present. The amount of mixing or overlap can be controlled by adjusting the target power and/or bias and/or background gas utilized in sputtering a layer over another layer. Higher power, higher bias or increased background gas generally results in a greater amount of mixing or overlap at the interface of the existing layer and the layer being applied. In some cases, this may be desirable for providing improved adherence.

EXAMPLE 1

A multilayer protective coating in accordance with the invention was made by dc magnetron sputtering from individual targets of carbon, molybdenum, molybdenum carbide ($Mo_2C$), and silicon onto valve piston rings, resulting in successive layers of carbon, molybdenum, molybdenum carbide and silicon. The deposition continued until the total thickness of the coating was about 3.2 micrometers. The thickness of each multilayer unit of carbon, molybdenum, molybdenum carbide and silicon was about 380 Angstroms. Silicon provided for corrosion resistance.

EXAMPLE 2

A multilayer protective coating in accordance with the invention was made by dc magnetron sputtering alternating layers of tungsten carbide and chromium to both sides of a flat plate. Each side of the plate was separately sputtered. One side had a multilayer unit (a layer of tungsten carbide and a layer of chromium) thickness of about 740 Angstroms and the other side had a multilayer unit thickness of about 1170 Angstroms. Chromium was provided for elasticity and tungsten carbide was provided for hardness.

While the invention has been described with respect to certain embodiments, it will be understood that various modifications and changes may be made without departing from the scope of the invention as set forth in the appended claims.

We claim:

1. A coating applied over a rigid substrate, said coating comprising a plurality of superimposed multilayer units, each unit comprising at least three compositionally different thin layers and each layer having a thickness sufficient to obtain its bulk coating properties, one of said layers comprising material for providing lubricity and selected from the group consisting of germanium, disordered transition metal boride material and fluorocarbon polymers, another of said layers for providing oxidation resistance and consisting of a material selected from the group consisting of titanium, carbon, silicon, stainless steel, and aluminum and another of said layers comprising material for providing hardness and wear resistance, and selected from the group consisting of carbon, tungsten and carbon, carbon and aluminum, aluminum and oxygen, titanium and boron, tungsten and boron, silicon and nitrogen, boron and nitrogen, tantalum and carbon, titanium and nitrogen, and titanium and carbon, the properties of said coating being a combination of the individual properties of said layers.

2. The coating of claim 1 wherein the thickness of said layers is less than the characteristic surface microstructure of said substrate.

3. The coating of claim 1 wherein said layers are in the range of from about 50 Angstroms to about 5000 Angstroms thick.

4. The coating of claim 1 wherein said plurality of multilayer units comprise repeating units.

5. The coating of claim 1 wherein said plurality of multilayer units is at least about 10.

6. The coating of claim 1 wherein said plurality of multilayer units is from about 10 to about 1,000.

7. The coating of claim 1 wherein said coating is from about 0.5 to about 10 micrometers thick.

8. The coating of claim 1 wherein one of said layers comprises material for providing shock resistance.

9. The coating of claim 8 wherein said material for providing shock resistance is chromium.

10. The coating of claim 1 wherein one of said layers comprises material for providing corrosion resistance.

11. The coating of claim 10 wherein said material for providing corrosion resistance is selected from the group consisting of: carbon; silicon; tantalum; and stainless steel.

12. The coating of claim 1 wherein the material for providing lubricity comprises disordered $Mo_xB_{1-x}$ where x is less than or equal to about 0.5.

13. The coating of claim 1 wherein said molybdenum and boron comprises disordered molybdenum and boron material.

14. The coating of claim 1 wherein the at least one of said layers for providing hardness and wear resistance comprises tungsten carbide and the other of said layers for providing lubricity comprises disordered $Mo_xB_{1-x}$ where x is less than or equal to about 0.5.

15. The coating of claim 1 wherein the material for providing lubricity comprises fluorocarbon material.

16. The coating of claim 1 comprising multilayer units of a first layer comprising carbon, a second layer comprising silicon, a third layer comprising molybdenum and a fourth layer comprising molybdenum carbide.

17. The coating of claim 1 wherein one of the layers in the multilayer unit is columnar and another of the layers in the multilayer unit is noncolumnar.

18. The coating of claim 1 wherein said substrate is a tool.

19. The coating of claim 1 wherein the material for providing lubricity comprises germanium.

20. The coating of claim 1 wherein the material for providing lubricity comprises fluorocarbon material.

* * * * *